US006257865B1

(12) United States Patent
Rondeau

(10) Patent No.: US 6,257,865 B1
(45) Date of Patent: Jul. 10, 2001

(54) APPARATUS FOR TEXTURIZING THE UPPER SURFACES OF CONCRETE PRODUCTS

(75) Inventor: Duane A. Rondeau, Alpena, MI (US)

(73) Assignee: Besser Company, Alpena, MI (US)

( * ) Notice: Subject to any disclaimer, the term of this patent is extended or adjusted under 35 U.S.C. 154(b) by 0 days.

(21) Appl. No.: 09/261,632

(22) Filed: Mar. 3, 1999

Related U.S. Application Data

(62) Division of application No. 08/788,585, filed on Jan. 24, 1997, now Pat. No. 5,942,181.

(60) Provisional application No. 60/011,016, filed on Feb. 1, 1996.

(51) Int. Cl.[7] ..... B28B 5/00; B28B 11/08

(52) U.S. Cl. ..... 425/385; 425/403.1; 425/404; 425/445

(58) Field of Search ..... 425/385, 403.1, 425/404, 445, 446; 264/233, 333, 344, 504, 570

(56) References Cited

U.S. PATENT DOCUMENTS

| | | |
|---|---|---|
| 788,379 | 4/1905 | Rich . |
| 968,591 | 8/1910 | Newton . |
| 1,588,841 | 6/1926 | Knapp . |
| 1,977,868 | 10/1934 | Tuttle . |
| 3,920,369 | 11/1975 | Boehinger et al. . |
| 3,985,848 | 10/1976 | Frische et al. . |
| 4,205,040 | 5/1980 | Aoyama et al. . |
| 4,235,580 | 11/1980 | Springs et al. . |
| 4,242,299 | 12/1980 | Adams . |
| 4,260,352 | 4/1981 | Balhorn . |
| 4,304,541 | 12/1981 | Cruse et al. . |
| 4,342,719 | 8/1982 | Cruse et al. . |
| 4,496,515 | 1/1985 | Ptasienski et al. . |
| 4,784,821 | 11/1988 | Leopold . |
| 4,941,949 | 7/1990 | Luszczak . |
| 5,246,650 | 9/1993 | Clark . |

FOREIGN PATENT DOCUMENTS

| | | |
|---|---|---|
| 0160148 | 5/1983 | (DE) . |

*Primary Examiner*—James P. Mackey
*Assistant Examiner*—Donald Heckenberg
(74) *Attorney, Agent, or Firm*—Reising, Ethington, Barnes, Kisselle, Learman & McCulloch, P.C.

(57) ABSTRACT

Apparatus, used with a molding machine for densifying and molding concrete products and releasing them in an uncured state wherein the upper surfaces comprise coarse aggregate and fines including a cement binder, textures the upper surfaces of the uncured concrete slab, stone and block products as they pass on a generally horizontally traveling conveyor. A force spraying station is positioned above the conveyor to direct a predetermined volumetric, overhead force spray of liquid at a substantially vertical spray angle with a pressure of only sufficient force to progressively loosen a predetermined amount of fines on the upper surfaces as the products move past. A blow off station at a predetermined distance downstream directs a predetermine curtain of gas only down at the upper surfaces of the products at a predetermined pressure adequate to blow off liquid and loosened fines from the upper surfaces of the products. The products pass on to a flooding station and then to a final blow off station for removing liquid and fines entrained in the flooding liquid.

15 Claims, 3 Drawing Sheets

APPARATUS FOR TEXTURIZING THE UPPER SURFACES OF CONCRETE PRODUCTS

This is a divisional application deriving from parent application, Ser. No. 08/788,585 filed Jan. 24, 1997, now U.S. Pat. No. 5,942,181, and also claims the priority of provisional application Ser. No. 60/011,016 filed Feb. 1, 1996.

This invention relates to the formation of texturized molded concrete products and, more particularly, to texturizing stations operating in conjunction with product molding machinery to force spray the upper surfaces of "green" molded concrete patio slabs, paving stones, retaining wall units, blocks, and the like being transported on molding machine pallets. The system, which is described in provisional application, Ser. No. 011,016, filed Feb. 1, 1996, from which priority is claimed, is incorporated with a molding machine to operate continuously in correlation with the speed that products are continuously molded and released on their molding and transport pallets.

BACKGROUND OF THE INVENTION

One of the salient features of the present system, which operates with horizontal discharge molding machines, such as shown in the present assignee's U.S. Pat. Nos. 4,260,352 and 4,235,580, both of which I incorporate completely herein by reference, is the treatment of the upper surfaces of the stones or products from above while the products move continuously in horizontal disposition on the molding machine discharge conveyor or an extension thereof. The texturizing which occurs is performed on the so-called "green" products before any curing takes place.

SUMMARY OF THE INVENTION

The method to be claimed involves treatment of the pallet-supported products moving on the molding machine conveyor in a continuous manner correlated with the speed of the molding machine. The conveyor transports the pallets through a texturizing system which includes the steps of providing high intensity liquid spray tubes or bars carrying a series of relatively closely spaced spray nozzles extending in a line broadside to the path of travel. The pair of water spray bars shown in the drawings are spaced apart such that the spacing between them is approximately equal to the length or diameter of the product proceeding past them. Downstream from them, and spaced from them about the same distance, is a so-called air knife which blows air under considerable pressure down upon the products and the cementitious particles which have been separated from the concrete matrices by the high pressure water spray nozzles. The air knife blows the water and these particles from the upper surfaces of the continuously moving products as they proceed on their molding pallets in the direction of pallet flow. Provided further downstream from the air knife, is a surface flooding water spray bar which sprays at a considerably reduced pressure and tends to entrain any final cementitious fines not previously removed.

Finally, the palleted products are encountered by a pair of final air knives which blow the liquid, with its entrained fines, off the surface of the pallets so that the pallets exit from the terminal air knives in a clean and texturized state. The products proceed on to a curing kiln, or to a curing shed where they are cured.

A typical textured surface is one which is attractively rough and has particles of aggregate exposed in the underlying concrete matrix to provide a highly desirable appearance. Alternatively, the spray can be controlled to simply rough the surface without exposing the particles of aggregate. The initial spraying, which is accomplished at a controlled high pressure, must be only of a duration to accomplish the purpose without unduly wetting the product so that it tends to sag out of shape. Typically, what is washed away is portland cement particles which may be referred to as the excess portland cement and smaller pebbles (i.e. fines), and what remains are relatively larger stones (i.e. aggregate) of a selected size, shape, and color bound together by a suitable concrete binder, to leave what may be termed an attractive texturized surface. The primary water spray intensity is such as to, if desired, exposed aggregate as deep as 0.375 inches.

One of the prime objects of the invention is to provide a system of the character described which can either be retrofitted to existing equipment, or placed on new equipment and incorporated into the molding machine control panel.

Another object of the invention is to provide a system in which each pallet remains horizontal and in motion, with no need for stopping or inclining the pallet, which steps require additional time.

Still another object of the invention is to provide a system of versatile character which permits controlled variance of both the quantity and pressure of the water sprayed on the top surface of the products being texturized.

Still another object of the invention is to provide a system with air knives capable of using amplified plant compressor air to produce high flow, high velocity curtains of air to blow off water and debris from the products and pallets, before the water has an opportunity to soak into the products, and to do this in a manner which creates considerable processing savings and reduces processing noise levels.

Still another object of the invention is to provide a system wherein a final cleaning of the product with fresh water is utilized, prior to the step of blowing the water off the pallets and products.

THE DRAWINGS

The presently preferred embodiment of the invention is disclosed in the following description and in the accompanying drawings, wherein.

DETAILED DESCRIPTION

Figure 1:
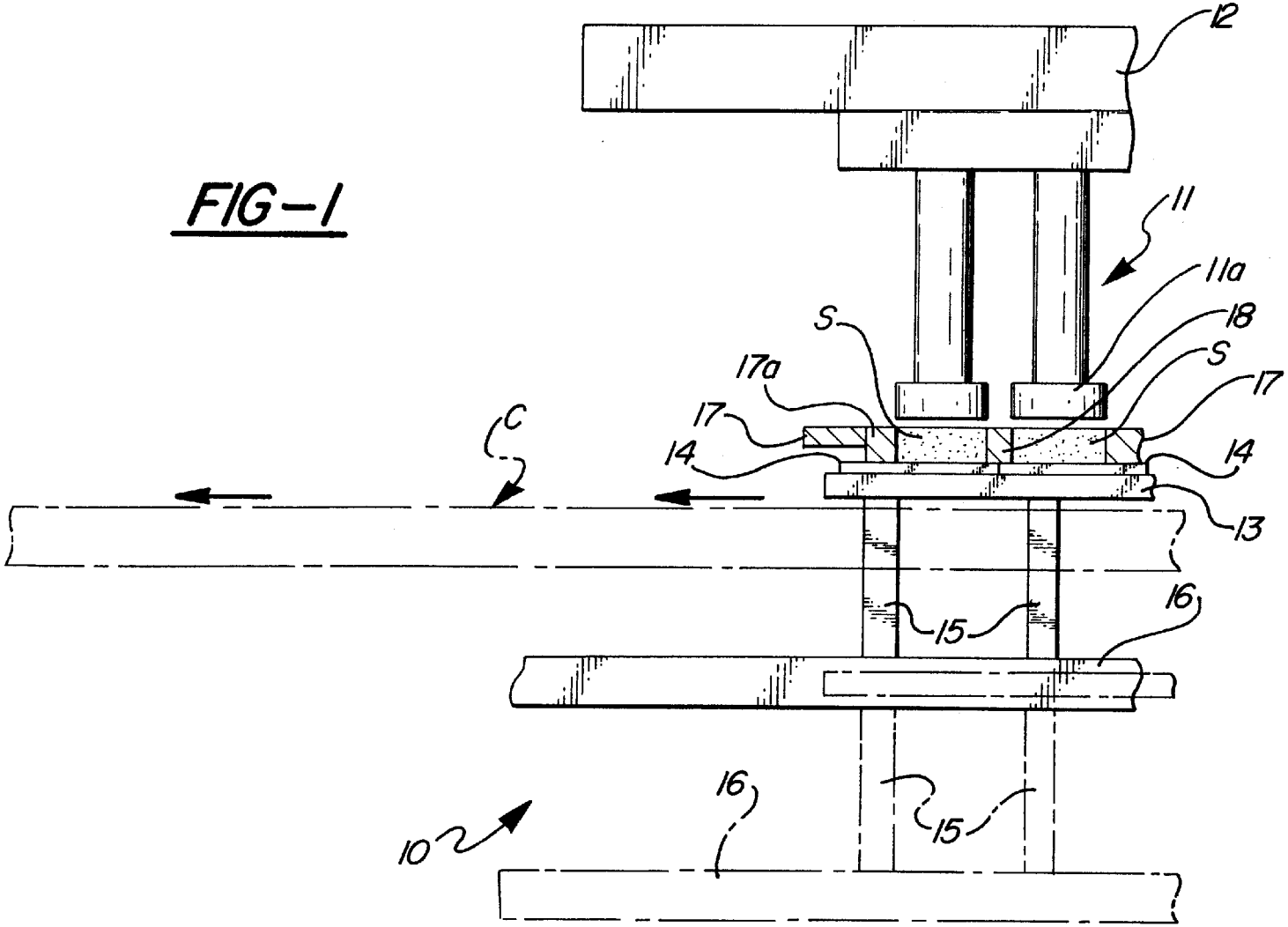
FIG. 1 is a schematic side elevational view illustrating the component parts of a concrete products molding machine.

Referring in the first instance more particularly to FIG. 1, a conventional molding machine generally designated 10 is shown as having a stripper head assembly 11 carried by a vertically movable stripper frame 12. Beneath the stripper head assembly 11 with its mold stripping blocks 11*a,* is a pallet support 13 on which a removable pallet 14 is supported, the pallet support 13 being fixed to upstanding column members 15 carried by a vertically movable lifter frame 16. Between the stripper head 11 and the pallet support 13 is mounted an open top and open bottom vibratable mold 17 in which the mixed concrete material may be molded into one or more concrete products, for instance, generally designated S. The mold has an upstanding peripheral wall 17*a* in the usual manner and is partitioned as shown at 18, as necessary to produce the number of products which are desired.

Figure 2:
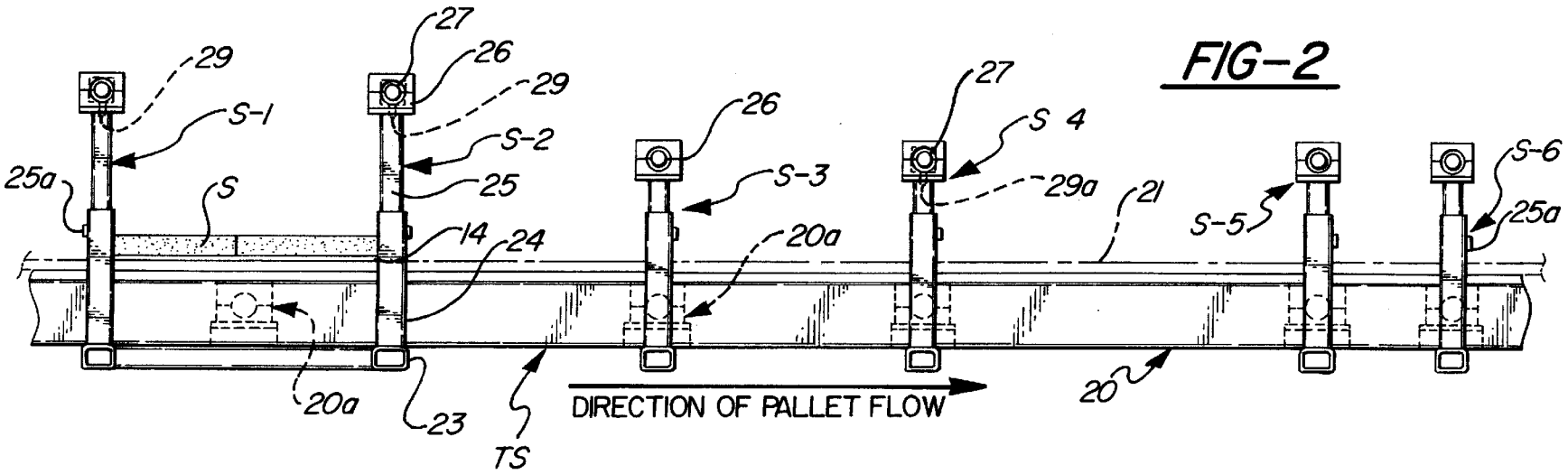
FIG. 2 is a side elevational view of the various elements of the texturizing station.
Figure 3:
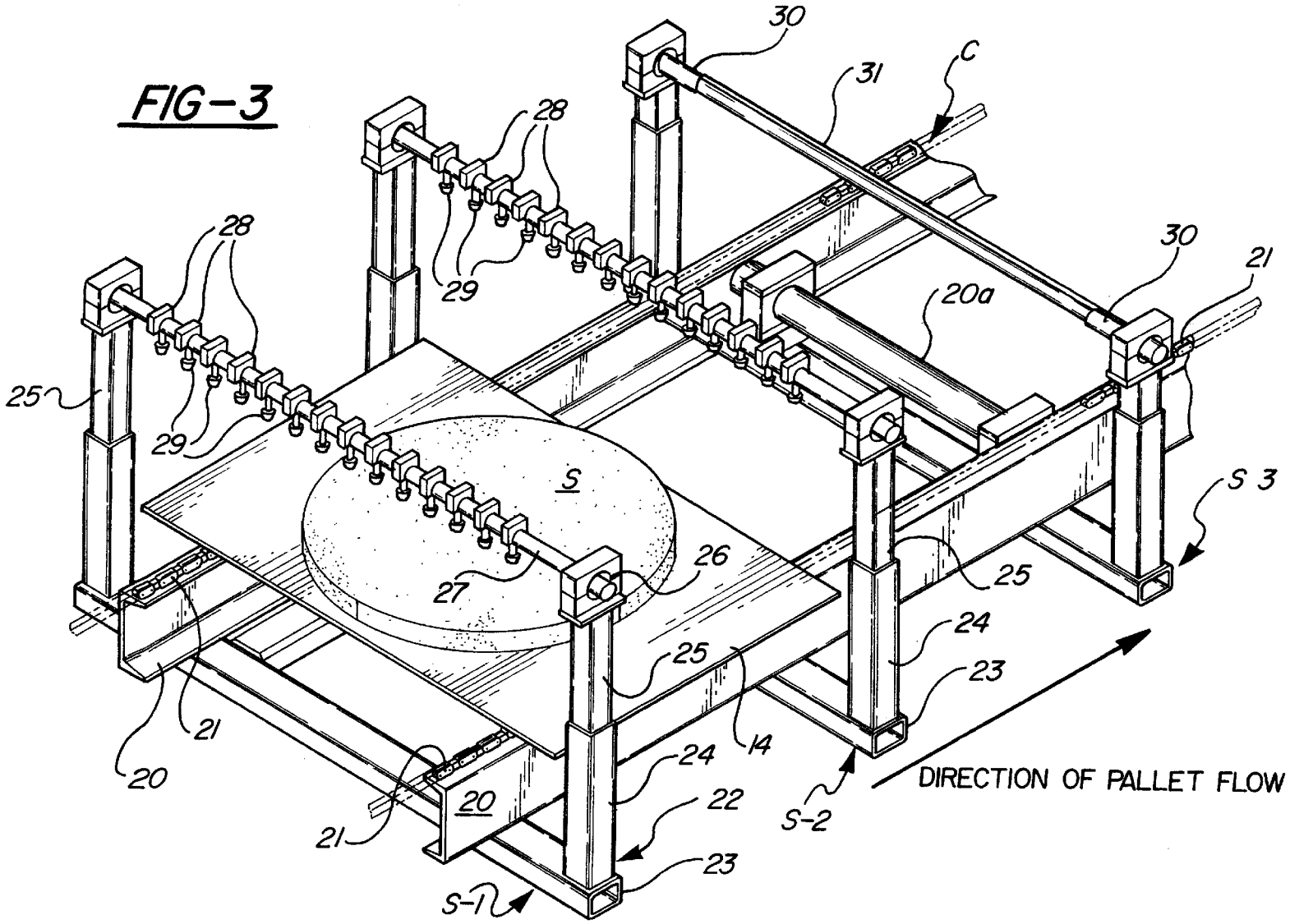
FIG. 3 is a fragmentary perspective plan view of certain of the components of the equipment disclosed in FIG. 2.

A conventional conveyor, generally designated C, and comprised of one conveyor, or several longitudinally adjacent conveyors, is provided for removing the pallets 14 from a lowered pallet support 13. It is to be understood that the stones S on their raised pallets 14 are stripped from the mold 17 and lowered by the lift frame assembly 16 to a level such that the pallets 14 are permitted to travel on conveyor C from right to left in FIG. 1, from the vicinity of the molding machine 10 to the texturizing station shown particularly in FIGS. 2 and 3. While only a single pallet 14 and product S are shown in FIGS. 2 and 3, for purposes of convenience, it should be understood that the products and pallets move continuously in the direction of pallet flow which, in FIGS. 2 and 3, is left to right. As indicated in these figures, the conveyor C which is illustrated includes longitudinally extending channel rails 20 on which a pair of spaced endless chains 21 run. Brace assemblies, generally designated 20*a,* can be provided to connect the rails 20. Supported by the rails 20, or in some other suitable fashion, are tubular frames, generally indicated by the numeral 22, which include crosswisely disposed tubes 23, and upstanding columns 24 within which tubular uprights 25 are telescopically received. Set screw members such as shown at 25*a,* or clamps can be used to anchor the uprights 25 in various telescoped positions. At their upper ends, the uprights 25 include fittings 26 for receiving water supplying pipes 27 on which a series of nozzle holders 28 are mounted in line in spaced apart relation at initial stations S-1 and S-2. Each of the holders or mount blocks 28 mounts a force spray nozzle or spray head 29 in communication with the interior of a pipe 27, and, as shown particularly in FIG. 3, the lines of spray heads 29 are arranged such that they span the diameter of the product S in approximately equally spaced apart relationship.

Figure 4:
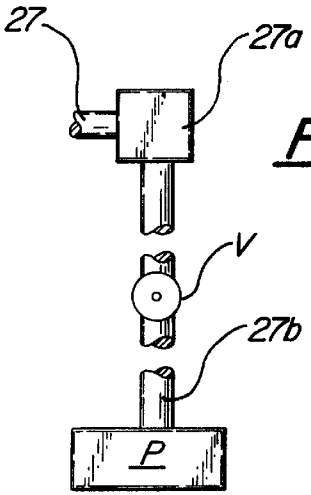
FIG. 4 is a schematic, fragmentary, elevational view of a typical water supply system.

As FIG. 4 schematically indicates, the nozzles 29 will be supplied with water under pressure by the pipes 27 which may connect through a fitting 27*a* with a supply pipe 27*b* leading from a suitable source of water under pressure such as a pump P. A suitable hand, or otherwise adjustable, valve V, which determines the intensity of the force spray egressing from nozzles 29, may be provided in pipe 27*b*. With nozzle 29 orifices of about 0.036 diameter providing a 25° diverging spray angle with water pressure in the range of about 40 psi to 120 psi, either a roughed surface without any substantial exposure of aggregate can be achieved at 60 psi, or an aggregate-exposed, pebbly surface can be achieved at about 120 psi.

Figure 5:
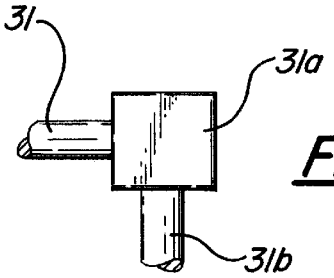
FIG. 5 is a schematic, fragmentary elevational view of a typical air supply system.

Immediately downstream from the second spray head assembly S-2, is a similar tubular assembly station S-3 which can be aptly termed a blow off station, and wherein the elements are the same, except that the mount assemblies 26 are provided with sleeves 30 for receiving an air emitting pipe 31 which may be termed an air knife or air knife assembly. The pipe 31 includes a single narrow slit in its lower surface which directs a curtain of air downward vertically under a pressure of about 80 psi. It will be observed in FIGS. 2 and 3 that the telescopic parts 24–25 position the pipe 31 at a reduced elevation relative to the water emitting pipes 27. FIG. 5 is a schematic view of a typical air supply system which includes a fitting 31*a* connecting a supply pipe 31*b* with the pipe 31. The pipe 31*b* may be connected with a compressor—accumulator system which includes a valve for controlling the air pressure.

At a surface flooding nozzle system station S-4, the various elements are substantially the same as at stations S-1 and S-2, except that the pipe 27 is positioned at a lower level. Further, only three equally spaced nozzles 29 are used. Stations S-1, S-2, S-3 and S-4, it will be noted, are stationed substantially the same distance apart approximating the diameter of the stones S being processed. As will later become apparent, the spray from nozzles 29*a* at station S-4 is emitted at only a sufficient pressure to pool or flood the upper surfaces of the product S proceeding past it to entrain any remaining cementitious fines or colloidal material in the liquid. The nozzle 29 orifices at station S-4 will be larger, i.e., about 0.148 inches in diameter, and the water will be supplied at a pressure of about 10–20 psi to create about a 110 degree spray angle.

Downstream from the station S-4 are a pair of more closely spaced air knife stations S-5 and S-6 which are identical to station S-3. In this case, the air pipes 31 at stations S-5 and S-6 are spaced apart such that both of them will be creating an air curtain on the same product S. This spacing assists in removing the liquid from the upper surface of each product S before it soaks into and deleteriously effects the green strength of the product. A tub (not shown) is provided longitudinally under the stations S-1 to S-6 to collect the water and debris.

The Operation

When a pallet 14 arrives at the molding machine 10 on conveyor C, it is just lifted off the conveyor C by lift assembly plate 13 to the position shown in FIG. 1. Following filling of the mold 17 in any suitable manner, such as that disclosed in U.S. Pat. No. 4,260,352, the stripper frame 12, with its stripper heads 12*a,* is lowered into the mold 17 as the latter is vibrated to compact the concrete. Following vibration, the stripper frame 12 and the pallet support lifter frame 16 are lowered, while the mold 17 is held stationary, so as to strip the molded product S from the mold 17. As the pallet support 13 is lowered, the pallet 14 is redeposited on the conveyor C which supplies it on its pallet 14 to the texturizing stations. The movement of the pallets 14 on conveyor C leaving the molding machine is continuous. If desired, conveyor C, as schematically shown in FIG. 1, could include a pair of conveyor sections, one section supplying empty pallets to the molding machine which is not traveling continuously, and the other section receiving the molded products on their pallets and traveling continuously to transfer molded products between the molding machine and the texturizing stations. At nozzle system stations S-1 and S-2, a force spray of water is directed at the upper surfaces of the stones or products as they proceed in the direction indicated. The washing away, or removal, of cementitious particles is achieved in a progressive manner as the product S travel past the pipes 27 of stations S-1 and S-2. At station S-3, the air under pressure is forced against the upper surfaces of the products S as they progressively pass it, with the result that loosened cementitious particles and water are blown off the products S and fall between the rails 12 to the collection tub positioned beneath. At station S-4, water under a considerably reduced pressure is emitted in a volume only to flood the upper surface of each product S sufficiently to entrain any remaining fines or colloidal particles of cement in the puddle formed on the surface. The emission of water is such that the products S are not appreciably soaked along their side edges, and the products S proceed on to stations S-5 and S-6. At stations S-5 and S-6 the air knives supply air under pressure at the same pressure, basically, as air is supplied at station S-3, and the pool of liquid on the upper surface of the product S is blown off to the underneath tub (not shown). The products S proceeding from station S-6 are free of any debris and the particles which are exposed provide an attractive upper surface in their cementitious matrix. At the speed of travel of the pallets 14, and with the amounts of liquid emitted at stations S-1, S-2, and S-4, products S will not have absorbed enough water to affect their strength, either in their green state such that they would tend to sag, or after curing.

It is to be understood that other embodiments of the invention which accomplish the same function are incorporated herein within the scope of any ultimately allowed patent claims.

I claim:

1. Apparatus for molding and texturizing the upper surfaces of non-cured concrete products having upper and lower faces bounded by a perimetral edge surface, the upper surfaces including coarse aggregate, fines, and a cement binder, comprising:

a. a generally horizontally disposed longitudinally extending conveyor driven continuously for receiving individual concrete products, with their upper surfaces uppermost from a concrete molding machine, to travel in a continuous stream in an uncured state along said conveyor;

b. an overhead force spraying station above said conveyor and said continuously moving stream of products having orifice mechanism for directing a predetermined volumetric overhead force spray of liquid at a predetermined, substantially vertical spray angle and pressure connected with a liquid source to force spray liquid with sufficient force to progressively loosen a predetermined amount of said fines on said upper surfaces as said products move past said force spraying station;

c. a first blow off station above said conveyor spaced a predetermined longitudinal distance downstream from said force spraying station connected with a gas supply for directing a high pressure flow of gas generally vertically at said upper surfaces of said products at a pressure to blow off much of said liquid and said loosened amount of fines from said upper surfaces of said products;

d. a flooding station spaced above said conveyor a predetermined longitudinal distance downstream from said first blow off station having orifice mechanism connected with a liquid supply for flooding said product upper surfaces with a lower pressure liquid in a volume sufficient only substantially to entrain remaining loose fines on said upper surfaces; and e. a second blow off station above said conveyor spaced a predetermined longitudinal distance downstream from said flooding station such that said products do not absorb enough liquid to affect their strength adversely, connected with a gas supply to create a gas flow at said upper surfaces to blow off said flooding liquid and said entrained fines to leave a textured surface substantially without loose fines on said upper surfaces of said products.

2. The combination of claim 1 with a concrete product molding machine for delivering molded products to said conveyor.

3. The apparatus of claim 1 wherein said orifice mechanism comprises nozzles at said force spray station provided in broadside lines spaced longitudinally apart about the longitudinal length of the products, which are sized and positioned to deliver a liquid spray which diverges at a spray angle of about 25 degrees, and an air knife curtain from said first blow off station is delivered at about 80 psi.

4. The apparatus of claim 1 wherein said apparatus is combined with a molding machine for densifying and molding said concrete products and releasing them with their upper surfaces uppermost in generally horizontal disposition on pallets to said conveyor in an uncured state wherein said upper surfaces comprise coarse aggregate and fines including a cement binder.

5. The apparatus of claim 1 wherein orifices at said force spraying station are of lesser cross-sectional area than orifices at said fines entraining flooding station.

6. The apparatus of claim 1 wherein said force spraying station comprises a mechanism for supplying said liquid pressure substantially in the range 40 to 120 psi.

7. The apparatus of claim 6 wherein said flooding station comprises a mechanism for supplying said liquid pressure substantially in the range 10 to 20 psi.

8. The apparatus of claim 1 wherein said flooding station orifice mechanism is smaller in size than said orifice mechanism at said force spraying station.

9. The combination with a concrete products molding machine of apparatus for texturing the upper surfaces of uncured concrete slab, stone and block products having upper surfaces and lower surfaces, bounded by perimetral edge surface, the upper surfaces including coarse aggregate, fines, and a cement binder, comprising:

a. a generally horizontally traveling longitudinally extending conveyor for receiving concrete products from said molding machine and moving them with their upper surfaces uppermost in generally horizontal spaced apart disposition in a continuous flow;

b. a force spraying station positioned above said conveyor comprising means for directing a predetermined volumetric, overhead force spray of liquid at a predetermined, substantially vertical spray angle and pressure with sufficient force to progressively loosen a predetermined amount of said fines on said upper surfaces as said products move in said generally horizontal disposition in a continuously moving stream past said overhead force spraying station; and c. a blow-off station positioned a predetermined distance downstream along said conveyor from said overhead force spraying station, to prevent excess absorption of liquid constructed with means for directing a curtain of gas from above said conveyor vertically down at said upper surfaces of said products at a predetermined pressure adequate to blow off liquid and a predetermined amount of loosened fines from said upper surfaces of said products and d. a flooding station downstream from said blow off station having means including nozzles for only flooding the upper surfaces of said products connected with a liquid supply.

10. The combination of claim 9, wherein said force spray station has nozzles with orifices and downstream of said blow off station, said flooding station is provided with transversely spaced, flooding spray nozzles, having greater area orifices than said force spray nozzles, and above said conveyor but at a level below said force spray nozzles, and mechanism connects thereto for supplying water as said liquid at a less pressure than said force spray pressure, so as to provide a flood layer to entrain any fines of concrete material remaining, and wherein a blow off station is provided downstream from said flooding station with gas curtain pressure creating mechanism extending transversely of and above said conveyor at a spaced distance from said flooding spray nozzles to ensure that said flooding liquid and entrained fines are blown off before sufficient liquid is absorbed to deleteriously affect the uncured and cured strength of the products.

11. The combination of claim 10 wherein said second blow off station comprises a pair of gas curtain creating mechanisms provided downstream from said flooding station in longitudinally spaced apart relation, and said gas curtain creating mechanisms comprise pipes with slits in the bottoms thereof connected with an air pressure source supplying air under a pressure of about 80 p.s.i.

12. The combination of claim 9 wherein said force spraying station includes a line of transversely spaced spray nozzles extending transversely generally perpendicular to the longitudinally extending conveyor.

13. The combination of claim 12 wherein said spray nozzles have orifices diverging the spray vertically at an angle of about 25° and said liquid pressure is in a range of 40–120 psi.

14. The combination of claim 9 wherein said force spraying station comprises a mechanism for supplying said liquid pressure in a pressure range of 40–60 psi.

15. The combination of claim 9 wherein said gas is directed to said product upper surfaces from a knife slit at a pressure of about 80 psi.

* * * * *